US006880858B2

(12) United States Patent
Norenberg

(10) Patent No.: US 6,880,858 B2
(45) Date of Patent: Apr. 19, 2005

(54) INDEXING DEVICE

(76) Inventor: Tyler Norenberg, 804 Promontory Pl., Eagan, MN (US) 55123

( * ) Notice: Subject to any disclaimer, the term of this patent is extended or adjusted under 35 U.S.C. 154(b) by 67 days.

(21) Appl. No.: 10/211,251

(22) Filed: Aug. 2, 2002

(65) Prior Publication Data

US 2004/0021309 A1 Feb. 5, 2004

(51) Int. Cl.[7] ..... B42F 21/00
(52) U.S. Cl. ..... 283/36
(58) Field of Search ..... 283/36, 37, 39, 283/38, 40, 41, 42, 43, 3

(56) References Cited

U.S. PATENT DOCUMENTS

| | | | | |
|---|---|---|---|---|
| 1,241,049 | A | * | 9/1917 | Stevens |
| 4,143,477 | A | | 3/1979 | Reynolds |
| 4,204,639 | A | * | 5/1980 | Barber et al. |
| 4,221,064 | A | * | 9/1980 | Sebastian |
| 4,240,848 | A | | 12/1980 | Barber |
| 4,676,372 | A | | 6/1987 | Rager |
| 4,720,123 | A | * | 1/1988 | Chelius |
| 5,341,982 | A | | 8/1994 | Syers |
| 5,417,457 | A | | 5/1995 | Reinhardt |
| 5,515,972 | A | | 5/1996 | Shames |
| 5,544,741 | A | | 8/1996 | Phantone et al. |
| 5,579,907 | A | | 12/1996 | Kedski |
| 5,590,770 | A | | 1/1997 | Yeh |
| 5,695,219 | A | | 12/1997 | Crawford |
| 5,724,757 | A | | 3/1998 | Warden |
| RE36,596 | E | | 3/2000 | Schneider |
| 6,039,354 | A | | 3/2000 | Mangler |

* cited by examiner

*Primary Examiner*—Jacob K. Ackun, Jr.
(74) *Attorney, Agent, or Firm*—Schwegman, Lundberg, Woessner & Kluth, P.A.

(57) ABSTRACT

A universal indexing device is shown that is flexible in use to accommodate multiple storage configurations including, but not limited to, vertical and horizontal storage. The indexing device includes a number of copies of an indexing symbol to accommodate a number of viewer angles. The indexing symbols are further oriented for convenient comprehension by the user. The flexible indexing device can be manufactured simply, out of a single piece of starting material and one product can be used to replace the multiple products that previously would have been required for multiple storage configurations.

3 Claims, 5 Drawing Sheets

INDEXING DEVICE

CROSS-REFERENCE TO RELATED APPLICATION AND CLAIM OF PRIORITY

This application claims priority under 35 U.S.C. 120 from U.S. application Ser. No.: 10/095,360, filed Mar. 11, 2002, entitled: INDEXING DEVICE, which application is incorporated herein by reference.

FIELD OF THE INVENTION

The invention relates to indexing devices. Specifically the invention relates to indexing devices that may be inserted between items in various configurations.

BACKGROUND OF THE INVENTION

Large collections of items require some form of organization in order to be able to effectively find one sought after item from amongst the larger collection. Some examples of collections include, but are not limited to, books, compact discs (CD's), file folders, videotapes, digital video discs (DVD's), etc. Collections of items such as these are frequently stored in units or locations that may include, but are not limited to vertical shelves, horizontal shelves, file cabinets, hanging folders, CD towers, drawers, storage boxes, etc.

One approach to organizing collections of items in units such as listed above has been to put the collections of items into order according to a title, letter, number, other symbol, or combination of symbols associated with each item in the collection. Using an example of CD collections, owners frequently put their collections into order on a shelf in alphabetical order by the name of the musical artist.

Large collections can be further organized by using a device or collection of devices such as index cards. A symbol, such as a letter of the alphabet is affixed to an edge of the index card. The card is then inserted next to items that correspond to the symbol on the edge of the card. Using the CD example, a letter of the alphabet such as an "A" is affixed to an edge of a card, and the "A" card is placed next to CD's with a musical artist who's name begins with "A." Other cards or indexing devices can be placed within the collection of items in a similar manner, thus the collection can be sub-divided into a number of more manageable sub-categories. Each sub-category is easily located by it's corresponding card or indexing device.

One problem with this approach is that a user may approach the collection from a number of different angles, and the symbol such as the letter "A" used in the previous example, will not be visible from some approach angles. Even if the symbol is visible, it may be oriented in a way that is not easily readable from some angles.

An additional problem exists with the limited flexibility of current indexing devices. Several storage configurations exist for storing collections of items. Using an example of CD storage, several different storage configurations are possible. Two examples include a vertical configuration and a horizontal configuration. It is desirable for the symbol to be easily readable, therefore the symbol must be suitably oriented on each manufactured variety of indexing device for each storage option.

A manufacturer of indexing devices currently must make a number of different indexing devices, each configured to accommodate various storage configurations, for example vertical and horizontal storage orientations. Additionally, a vendor that wishes to sell indexing devices must place orders, keep inventory, and use display space for several varieties of indexing devices that are designed for different storage configurations. The requirement for multiple configurations is more complicated and costly for manufacturers, and vendors. Further, consumers who purchase a single indexing device product are currently limited to one storage orientation. No single device is currently available to satisfy the above listed industry needs.

What is needed is a single indexing device that is flexible in use to be universally applied to multiple storage configurations. What is also needed is an indexing device that is easily readable from various angles. What is also needed is an indexing device that is simple and inexpensive to manufacture and distribute to consumers.

SUMMARY OF THE INVENTION

The above mentioned problems of flexibility, readability, and manufacturing/distribution cost are addressed by the present invention and will be understood by reading and studying the following specification. Devices and methods are provided for indexing a number of items in a collection. The devices, and methods of the present invention offer increased flexibility to accommodate multiple storage configurations. The devices, and methods of the present invention further offer a design that is simple and inexpensive to manufacture and distribute to consumers. The devices, and methods of the present invention further offer improved user advantages such as readability from a number of angles of view.

An indexing device is shown that includes a body portion, the body portion having a first side and a second side. The indexing device includes a number of copies of an indexing symbol attached to the body portion, the symbol having a top, a bottom, a left side and a right side. The copies of the indexing symbol include a first copy of the symbol attached to the first side; a second copy of the symbol attached to the first side in a different orientation from the first copy of the symbol; a third copy of the symbol attached to the second side; and a fourth copy of the symbol attached to the second side in a different orientation from the third copy of the symbol.

Also shown is a method of manufacturing an indexing device. The method includes forming a body portion, the body portion having a first side and a second side. The method further includes attaching a number of copies of an indexing symbol to the body portion, the symbol having a top, a bottom, a left side and a right side. A first copy of the symbol is attached to the first side; a second copy of the symbol is attached to the first side in a different orientation from the first copy of the symbol; a third copy of the symbol is attached to the second side; and a fourth copy of the symbol is attached to the second side in a different orientation from the third copy of the symbol.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

Figure 1A:
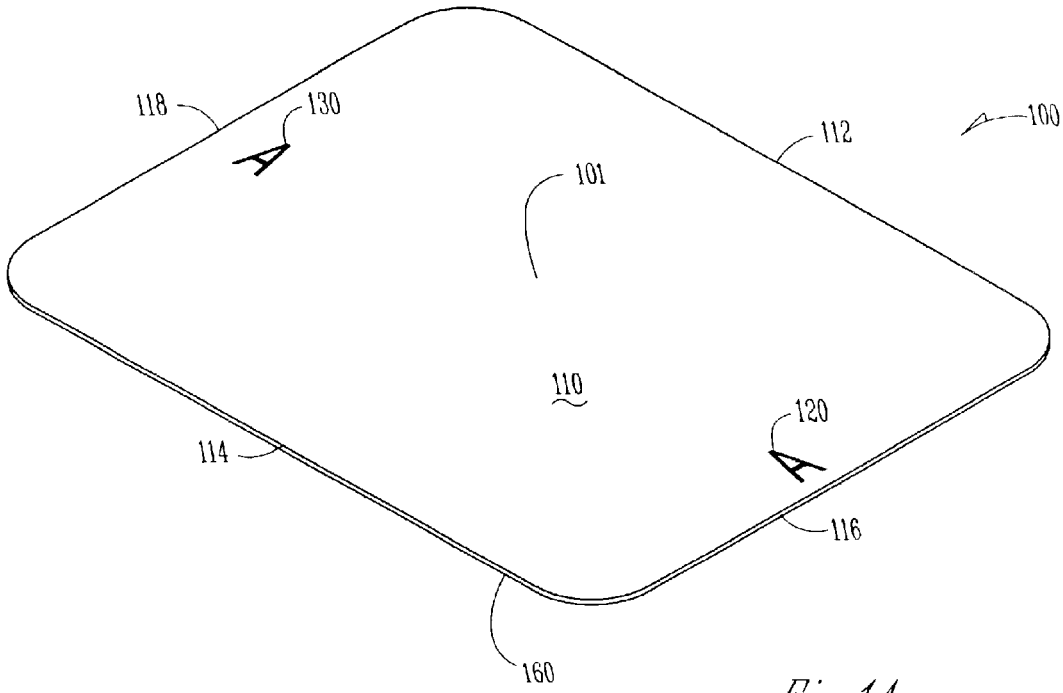
FIG. 1A shows a perspective view of an indexing device.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural changes, logical changes, etc. may be made without departing from the scope of the present invention.

FIG. 1A shows an indexing device 100 according to one embodiment of the invention. A body portion 101 is shown with a first side 110 and a second side 160. The embodiment shown in FIG. 1A includes a card-shaped indexing device in a substantially rectangular, card-shaped configuration. Other configurations of the body portion include square shaped, or other two-dimensional geometric configurations. Additionally, the body portion 101 may have a more substantial thickness than the substantially card-shaped embodiment of FIG. 1A. Other examples of body portions may include three dimensionally folded material. A body portion in the form of a tab that is affixed to a comer, or portion of an item in a collection is also contemplated within the scope of the invention.

The body portion in FIG. 1A includes a first lateral side 112 and a second lateral side 114. A first end 116 and a second end 118 are further included, with a number of copies of an indexing symbol shown attached to the first side 110 of the body portion 101. Another embodiment includes the first end 116 and the second end 118 being located on long ends of a substantially rectangular body region 101. Still another embodiment includes the first end 116 and the second end 118 being located on adjacent ends instead of opposite ends.

Figure 1B:
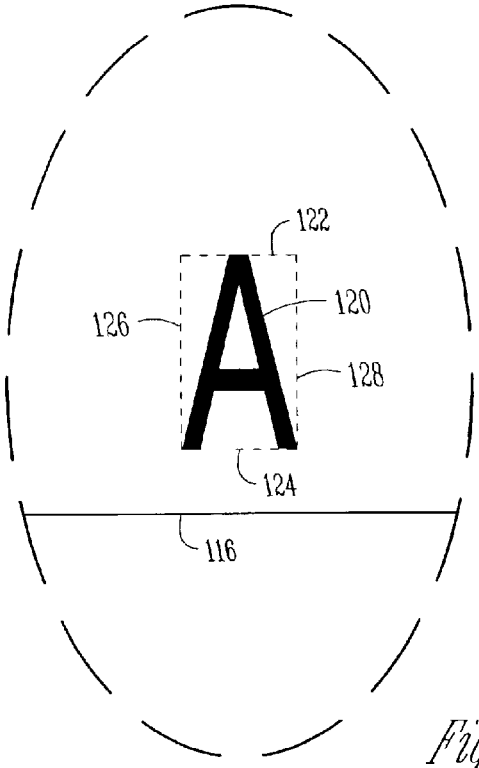
FIG. 1B shows a plan view of one embodiment of an indexing symbol.

FIG. 1B shows one embodiment of a first copy 120 of an indexing symbol. In one embodiment, multiple copies of the indexing symbol are included on the indexing device 100. One skilled in the art will appreciate that the general description of the first copy 120 of the indexing symbol will apply to additional copies of the indexing symbol as well. The first copy 120 of the indexing symbol includes a top side 122, a bottom side 124, a left side 126 and a right side 128. In one embodiment, the indexing symbol includes a letter of the alphabet. Other embodiments of indexing symbols include, but are not limited to, numbers, geometric shapes, abstract figures, or combinations of all of the above possibilities. The indexing symbol typically will have a meaningful relation to a collection of items that it is designed to organize.

Although individual copies of the indexing symbol, such as the first copy 120 are characterized by FIG. 1B, the orientations of each copy of the indexing symbol, and the spatial relationship of copies of indexing symbols to each other is further described in the remaining figures and the following detailed description.

Figure 1C:
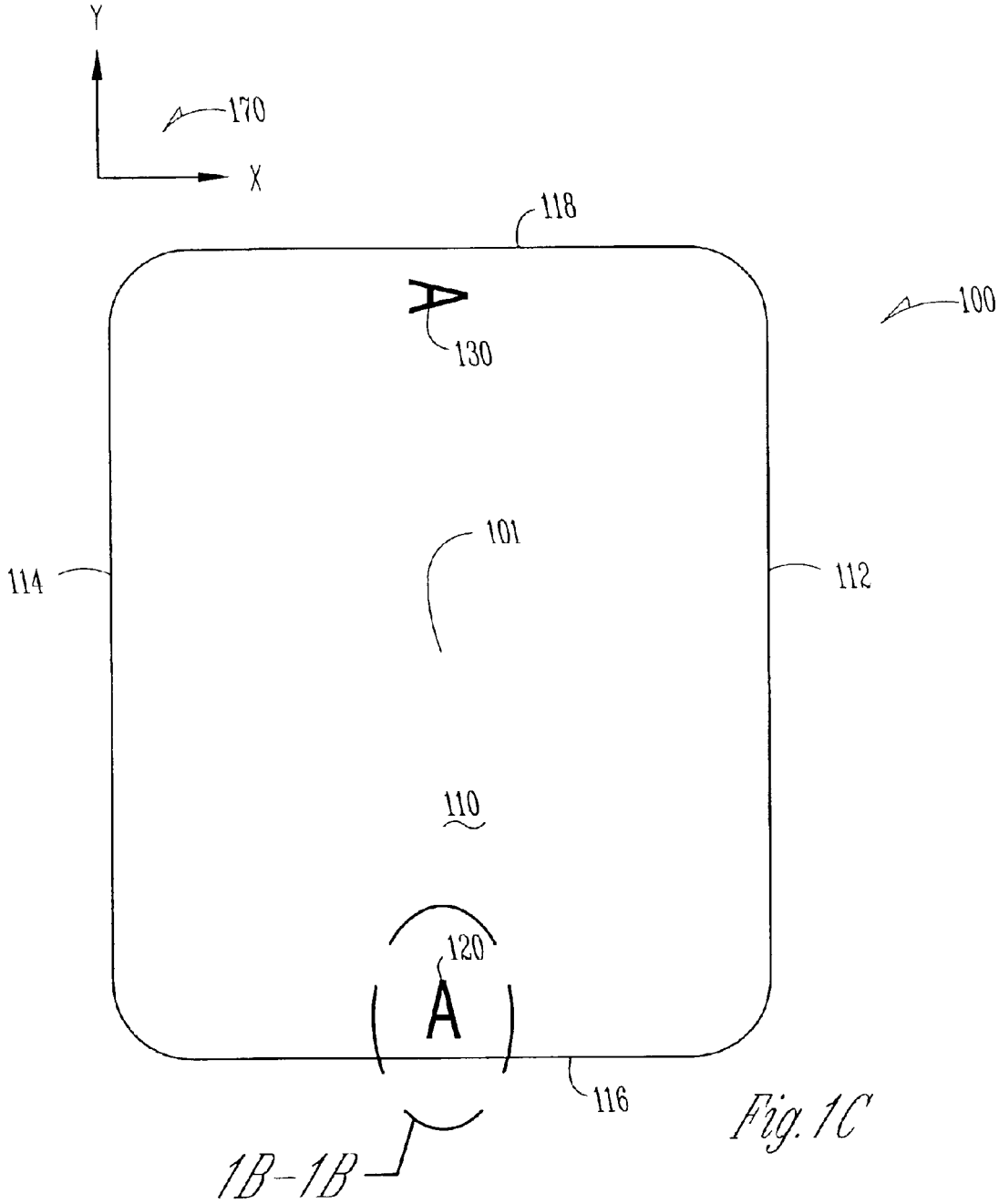
FIG. 1C shows a top view of an indexing device.

FIG. 1C shows the first side 110 of the body portion 101. The first copy 120 of the indexing symbol is attached to the first side 110, along with a second copy 130 of the indexing symbol. The copies of the indexing symbol can be attached in a number of various methods. Methods of attachment include marking methods such as etching, or printing. Alternatively, a separate indexing symbol may be produced and affixed to the body portion 101. Adhesives, mechanical containment envelopes, etc. are acceptable means of attaching a separate indexing symbol.

In FIG. 1C, the first copy 120 of the indexing symbol is located on the first end 116 of the body portion 101. The second copy of the indexing symbol is located on the second end 118 of the body portion 101. Coordinate axes 170 are shown in FIG. 1C to indicate direction relative to the first side 110. In one embodiment, the first copy 120 of the indexing symbol is located at a center of the first end 116 along the x-axis. In one embodiment, the second copy 130 of the indexing symbol is located at a center of the second end 118 along the x-axis. Other locations, such as the corners of the first side 110 are also contemplated.

In one embodiment, the second copy 130 of the indexing symbol is rotated approximately 90 degrees from the first copy 120 of the indexing symbol. In one embodiment the bottom side 124 of the first copy 120 of the indexing symbol is located adjacent to the first end 116 of the body portion 101. In one embodiment the left side 126 of the second copy 130 of the indexing symbol is located adjacent to the second end 118 of the body portion 101.

Figure 1D:
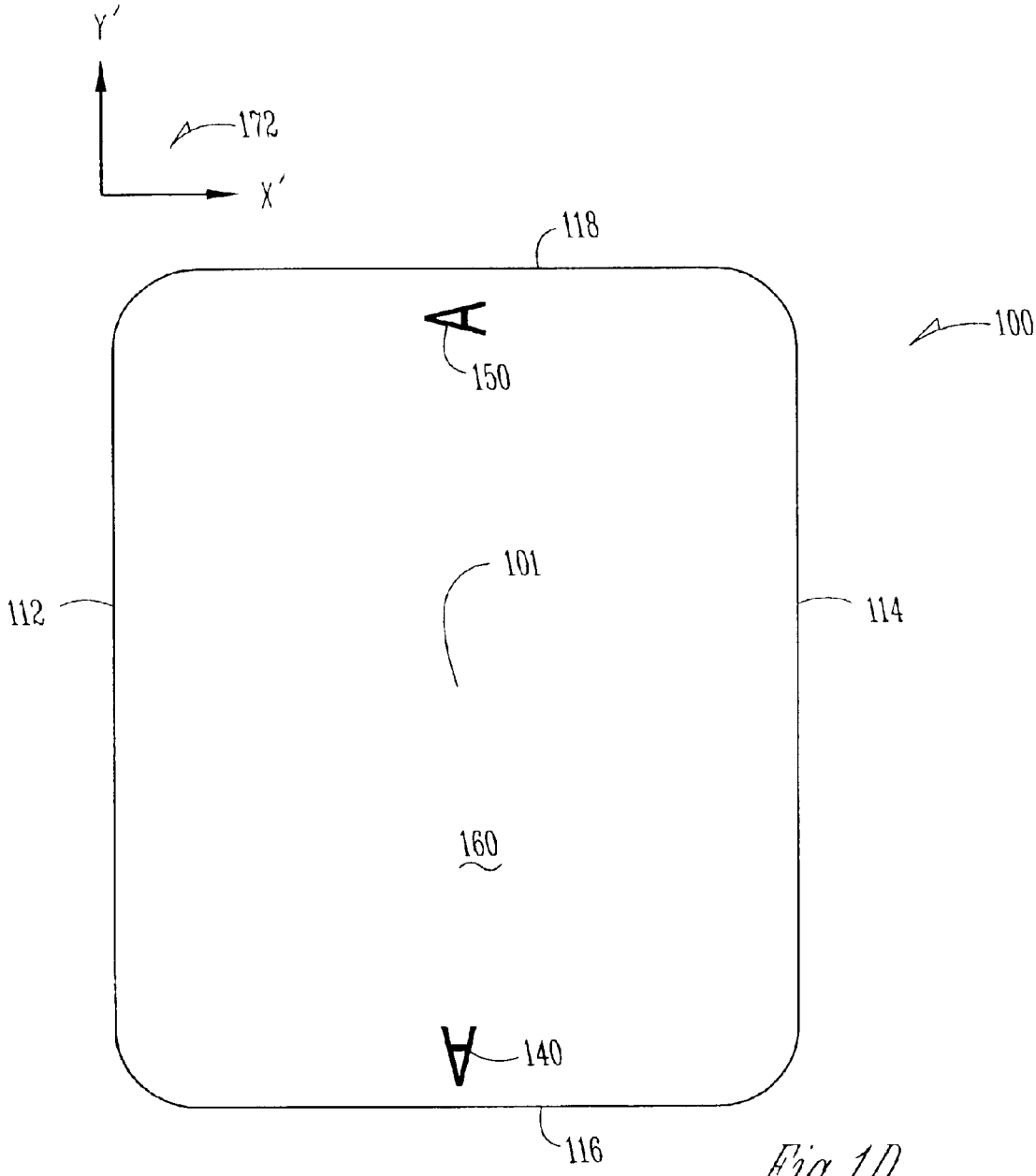
FIG. 1D shows a bottom view of an indexing device.

FIG. 1D shows the second side 160 of the body portion 101. A third copy 140 of the indexing symbol is attached to the second side 160, along with a fourth copy 150 of the indexing symbol.

In FIG. 1D, the third copy 140 of the indexing symbol is located on the first end 116 of the body portion 101. The fourth copy of the indexing symbol is located on the second end 118 of the body portion 101. Coordinate axes 172 are shown in FIG. 1D to indicate direction relative to the second side 160. In one embodiment, the third copy 140 of the indexing symbol is located at a center of the first end 116 along the x'-axis. In one embodiment, the fourth copy 150 of the indexing symbol is located at a center of the second end 118 along the x'-axis. Other locations, such as the corners of the second side 160 are also contemplated.

In one embodiment, the fourth copy 150 of the indexing symbol is rotated approximately 90 degrees from the third copy 140 of the indexing symbol. In one embodiment the top side 122 of the third copy 140 of the indexing symbol is located adjacent to the first end 116 of the body portion 101. In one embodiment the right side 128 of the fourth copy 150 of the indexing symbol is located adjacent to the second end 118 of the body portion 101.

As previously discussed, in one embodiment, the body portion is formed from a card-like material. In one configuration using a card-like material, the first side 110 and the second side 160 are substantially parallel and opposite to each other. Other embodiments using an alternate body portion configuration may choose the first and second sides to be oriented differently with respect to each other. Other examples of alternate configurations may include the first and second sides 110, 160 being adjacent to each other. In one embodiment, the first and second sides 110, 160 are substantially orthogonal to each other.

Using an illustration with substantially parallel and opposite first and second sides 110 and 160, the copies of the indexing symbols can be related to each other in three dimensional space from the first side 110 to the second side 160. The first copy 120 of the indexing symbol in one embodiment is located substantially opposite the third copy 140 of the indexing symbol. Likewise, in one embodiment, the second copy 130 of the indexing symbol is located substantially opposite the fourth copy 150 of the indexing symbol.

Figure 2:
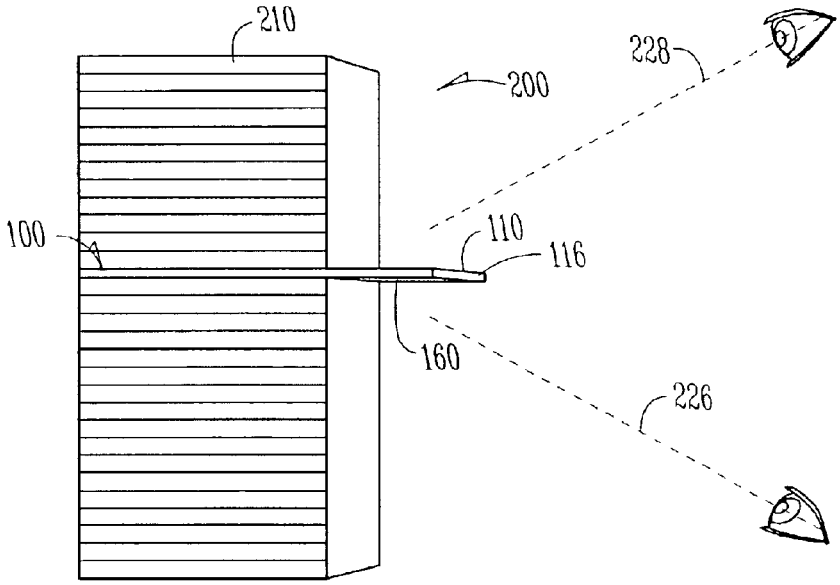
FIG. 2 shows one possible vertical storage configuration with an indexing device.

The particular choice of copies of the indexing symbols and their orientations on various sides has a number of advantages. FIG. 2 illustrates one example of a collection of items 200. Individual items 210 are contained within the collection 200. Individual items may include, but are not limited to books, compact discs (CD's), file folders, videotapes, digital video discs (DVD's), etc. CD's will be used as an example for illustration of advantages of the present novel indexing device.

In one storage configuration, the CD's are housed in a vertical configuration as shown in FIG. 2. One indexing device 100 is shown in FIG. 2, that divides the collection 200 into two sub-categories. A plurality of indexing devices may also be used to further sub-divide the collection 200. The first side 110 and the second side 160 are shown along with the first end 116. A user may view the indexing device 100 from a number of different angles of approach. The eye icons shown in FIG. 2 indicate two possible user angles of approach. A user approaching the indexing device 100 from direction 228 will view the first side 110 of the indexing device 100, while a user approaching the indexing device 100 from direction 226 will view the second side 160 the indexing device 100.

The inclusion of a copy of an indexing symbol on both the first side 110 of the indexing device 100 and the second side 160 of the indexing device 100 has the advantage of allowing both user directions 226 and 228 to view a copy of the indexing symbol. Further the copies of the indexing symbols are oriented such that the normal top side of the indexing symbol is "up" from the user's viewing perspective.

In the configuration shown in FIG. 2, the first copy 120 of the indexing symbol is visible on the first side 110, with the bottom side 124 of the indexing symbol adjacent to the first end 116 in a convenient reading position for the user. Likewise, the third copy 140 of the indexing symbol is visible on the second side 160, with the top side 122 of the indexing symbol adjacent to the first end 116 in a convenient reading position for the user.

Figure 3:
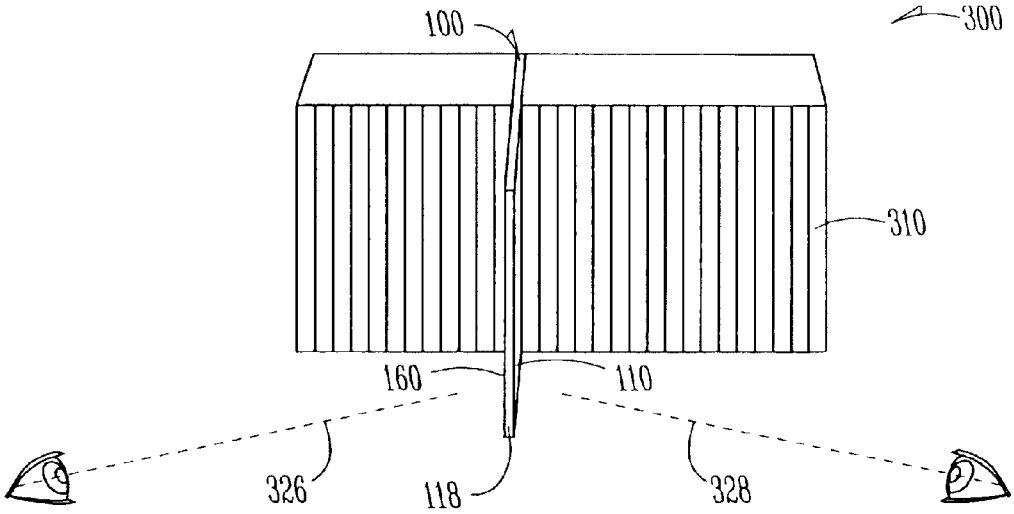
FIG. 3 shows one possible horizontal storage configuration with an indexing device.

FIG. 3 shows a horizontal storage configuration. The indexing device 100 is shown in FIG. 3, dividing a collection 300 into two sub-categories. A plurality of indexing devices may again be used to further sub-divide the collection 300. The first side 110 and the second side 160 are shown along with the second end 118. A user approaching the indexing device 100 from direction 328 will view the first side 110 of the indexing device 100, while a user approaching the indexing device 100 from direction 326 will view the second side 160 the indexing device 100.

The inclusion of a copy of an indexing symbol on both the first side 110 of the indexing device 100 and the second side 160 of the indexing device 100 has the advantage of allowing both user directions 326 and 328 to view a copy of the indexing symbol. Further the copies of the indexing symbols are oriented such that the normal top side of the indexing symbol is "up" from the user's viewing perspective.

In the configuration shown in FIG. 3, the second copy 130 of the indexing symbol is visible on the first side 110, with the left side 126 of the indexing symbol adjacent to the second end 118 in a convenient reading position for the user. Likewise, the fourth copy 150 of the indexing symbol is visible on the second side 160, with the right side 128 of the indexing symbol adjacent to the second end 118 in a convenient reading position for the user.

Figure 4:
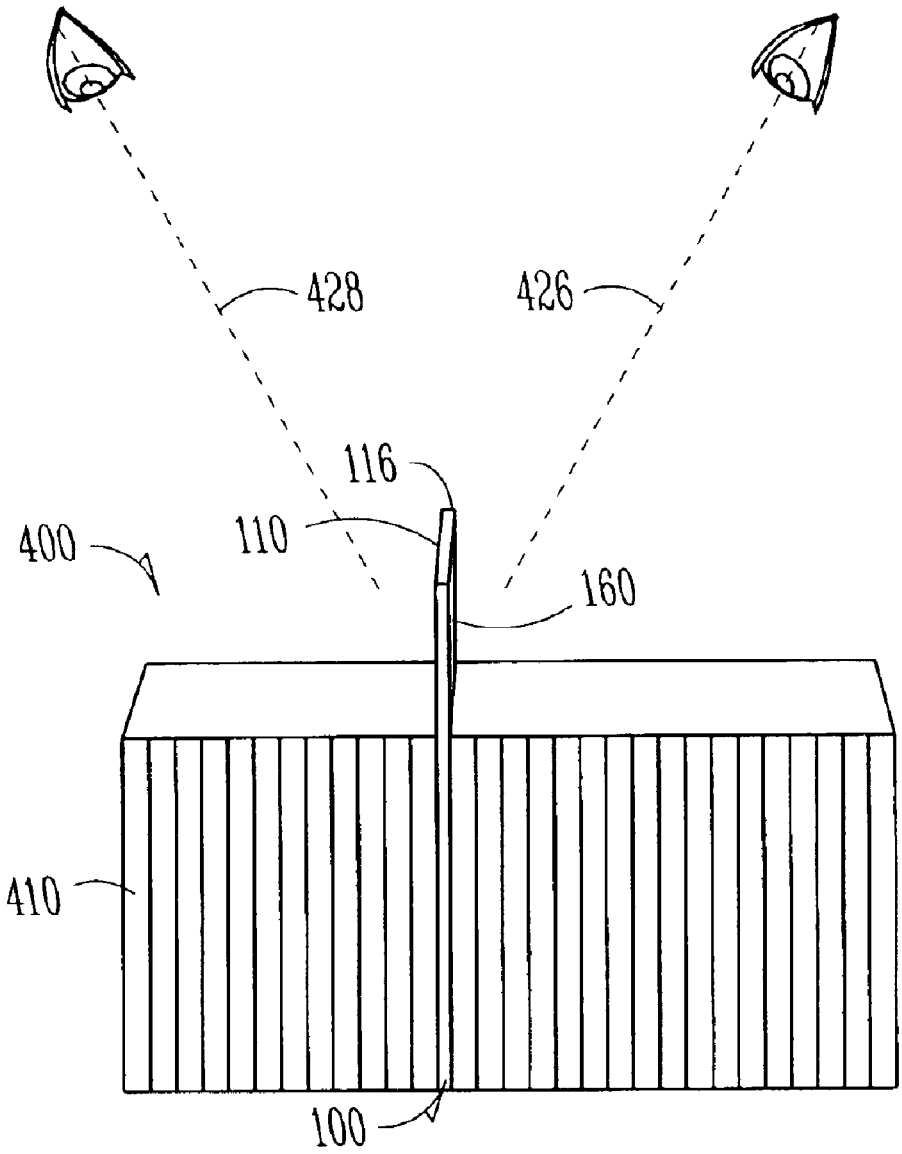
FIG. 4 shows another possible horizontal storage configuration with an indexing device.

FIG. 4 shows an additional horizontal storage configuration. Some examples of this storage configuration include, but are not limited to, drawer storage, and sales displays in retail stores. The indexing device 100 is shown in FIG. 4, dividing a collection 400 into two sub-categories. A plurality of indexing devices may again be used to further sub-divide the collection 400. The first side 110 and the second side 160 are shown along with the first end 116. A user approaching the indexing device 100 from direction 428 will view the first side 110 of the indexing device 100, while a user approaching the indexing device 100 from direction 426 will view the second side 160 the indexing device 100. The inclusion of a copy of an indexing symbol on both the first side 110 of the indexing device 100 and the second side 160 of the indexing device 100 has the advantage of allowing both user directions 426 and 428 to view a copy of the indexing symbol.

In the configuration shown in FIG. 4, the first copy 120 of the indexing symbol is visible on the first side 110, with the bottom side 124 of the indexing symbol adjacent to the first end 116 in a convenient reading position for the user. Likewise, the third copy 140 of the indexing symbol is visible on the second side 160, with the top side 122 of the indexing symbol adjacent to the first end 116 in a convenient reading position for the user.

A further advantage of an indexing device utilizing the novel designs described above is that multiple configurations of collection storage, such as vertical and horizontal storage, can be accommodated. The indexing device shown is a simple, one piece design, that can be rotated such that either the first end 116 or the second end 118 is visible to the user. The first end 116, in one embodiment, is suited for at least one particular collection housing configuration such as vertical storage. The second end 118, in one embodiment, is suited for other particular collection housing configurations such as horizontal storage.

CONCLUSION

Thus has been shown a universal indexing device that is flexible in use to accommodate multiple storage configurations including, but not limited to, vertical and horizontal storage. The indexing device shown includes a number of copies of an indexing symbol to accommodate a number of viewer angles. The indexing symbols are oriented accordingly for convenient comprehension by the user. The universal indexing device can be manufactured simply, out of a single piece of starting material, if desired, and one product can be used to replace the multiple products that previously would have been required for multiple storage configurations.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. An indexing device, comprising:

a body portion, having a first side and a substantially parallel and opposite second side;

a number of copies of an indexing symbol attached to the body portion, the symbol having a top, a bottom, a left side and a right side, including:

a first copy of the symbol attached to the first side with the top of the symbol adjacent to a first end;

a second copy of the symbol attached to the first side with the right side of the symbol adjacent to a second end;

a third copy of the symbol attached to the second side, substantially opposite to the first copy of the symbol, with the bottom of the third copy of the symbol adjacent to the first end; and a fourth copy of the symbol attached to the second side, substantially opposite to the second copy of the symbol, with the left side of the fourth copy of the symbol adjacent to the second end.

2. The indexing device of claim 1, wherein the identifying symbol includes a letter of the alphabet.

3. The indexing device of claim 1, wherein the identifying symbol includes a number.

* * * * *